US006564398B1

(12) United States Patent
Trott

(10) Patent No.: US 6,564,398 B1
(45) Date of Patent: May 20, 2003

(54) SINK SPLASH GUARD

(76) Inventor: Saundra Trott, 5180 Cameron St., Suite 4, Las Vegas, NV (US) 89118

( * ) Notice: Subject to any disclaimer, the term of this patent is extended or adjusted under 35 U.S.C. 154(b) by 351 days.

(21) Appl. No.: 09/130,383

(22) Filed: Aug. 6, 1998

(51) Int. Cl.[7] ..... E03C 1/12
(52) U.S. Cl. ..... 4/658
(58) Field of Search ..... 4/300.3, 559, 580, 4/630, 654, 656, 658

(56) References Cited

U.S. PATENT DOCUMENTS

| | | | | | |
|---|---|---|---|---|---|
| RE11,414 | E | | 4/1894 | Huss | 312/140.4 |
| 1,221,137 | A | | 4/1917 | Carney | 4/658 |
| 1,234,658 | A | * | 7/1917 | Gray | 4/658 X |
| 1,302,658 | A | | 5/1919 | Henning | 4/658 |
| 1,857,328 | A | * | 5/1932 | Piper | 4/144.1 |
| 2,508,808 | A | | 5/1950 | Warman | 4/658 |
| 2,510,238 | A | | 6/1950 | Mau | 4/658 |
| 2,514,001 | A | * | 7/1950 | Knuth | 4/658 X |
| 4,620,332 | A | * | 11/1986 | Laird | 4/559 |
| 4,878,257 | A | | 11/1989 | Hardin | 4/658 |
| 5,012,537 | A | | 5/1991 | Underwood | 4/658 |
| 5,381,564 | A | * | 1/1995 | Carroll | 4/559 |
| 5,625,910 | A | | 5/1997 | Erickson et al. | 4/658 |

FOREIGN PATENT DOCUMENTS

| | | | | |
|---|---|---|---|---|
| FR | 792401 | * | 12/1935 | 4/658 |

* cited by examiner

*Primary Examiner*—Robert M. Fetsuga
(74) *Attorney, Agent, or Firm*—Anderson & Morishita, LLC; Philip J. Anderson

(57) ABSTRACT

A splash guard for a sink is set forth which includes a panel having a longitudinal dimension substantially co-extensive with the front of a sink. At the top the panel has an upper margin and at the bottom a trough. The guard is adapted to be removably secured to the cabinet containing the sink at the upper margin such that the panel is disposed in front of the cabinets below the sink to prevent splashes from falling on the cabinets. The trough directs any splashes away from the cabinets.

1 Claim, 1 Drawing Sheet

SINK SPLASH GUARD

FIELD OF THE INVENTION

The present invention relates to guards to protect the face of a cabinet below a sink from splashes, water and other materials during use of the sink.

BACKGROUND OF THE INVENTION

In many homes and businesses a significant investment is made in cabinetry, particularly wood or wood faced cabinetry. In a kitchen, laundry room or the like a sink or double sink is provided in the cabinet top as is well known. During use of the sink, water, food or other substances such as paint may splash from the sink and fall to the face of the cabinet below the sink. The splashes may discolor, warp or otherwise damage the face of the cabinet under the sink.

There is a need for a device which can protect the face of the cabinet below the sink, which is not unsightly, which can be removed when desired and which is adapted to either temporarily retain any splashes or direct them away from the cabinet face.

SUMMARY OF THE INVENTION

There is therefor set forth according to the present invention a guard adapted to prevent water and other substances from splashing from a sink down, over the face of a cabinet. The guard includes a panel of a size to project downwardly from the counter top above the cabinet over the face of the cabinet and substantially co-extensive with the dimension of the sink above the cabinet face. The panel has an upper margin disposed at an angle to overlay the counter top to suspend the panel over and in front of the cabinet face. A lower margin includes a trough to catch any water or other substance running down the panel and prevent it from impinging upon the cabinet face. Means are provided to removably secure the guard in place so that will not inadvertently be dislodged from its intended position.

Accordingly when someone wishes to use the sink to, for example clean paint brushes or wash dishes, the guard is positioned to depend from the counter top in front of the cabinet face under the sink and between the user and the sink. Any splashes which fall from the sink are prevented, by virtue of the guard, from hitting and staining or marring the cabinet face.

BRIEF DESCRIPTION OF THE DRAWINGS

These and other features and advantages will become appreciated when the same becomes better understood with reference to the specification, claims and drawings wherein:

DESCRIPTION

Figure 1:
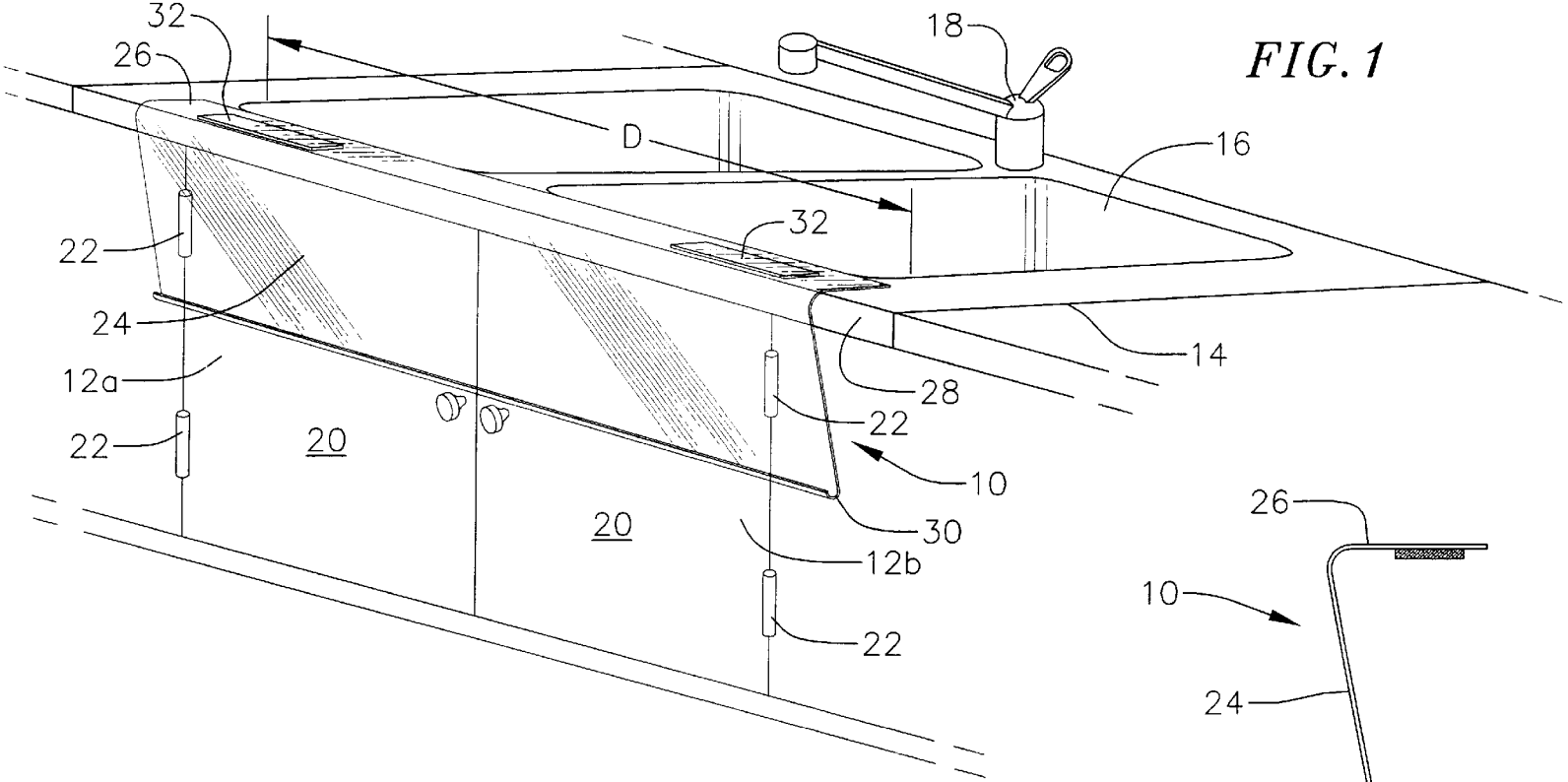
FIG. 1 is a front perspective view of the guard in place in front of the sink.

Turning to the drawings, FIG. 1 shows a guard 10 according to the present invention. The guard 10, as described fully below, is adapted to be used in the environment. This environment includes cabinets 12*a,b* supporting a counter top 14 including a sink, shown as a double sink 16. While the description as hereafter set forth is directed to the situation shown in FIG. 1, it is to be Understood that the guard 10 could be used in other applications, for example, where the sink is a pedestal sink or any other environment where it is desired to confine and capture splashes from the sink 16. To supply water to the sink, there is a faucet 18 as is well known in the art.

The cabinets 12*a,b* include faces 20 which may be finished or otherwise susceptible to damage by splashing of water in other products from the double sink 16. For example, were one to wash out paint brushes or the like in the double sink 16, splashing of paint onto the faces 20 may discolor the faces 20 requiring expensive re-facing or replacement. Furthermore, simply washing dishes may result in water spraying forwardly from the sink over the counter top 14 to the faces 20 of the cabinets 12*a,b*.

Each of the cabinets 12*a,b* includes hinges 22 as is well known in the art.

To protect to the cabinets 12*a,b* and the faces 20 thereof, the guard 10 is positioned as shown in FIG. 1. The guard 10 includes a panel portion 24 which is substantially planar having a longitudinal dimension to substantially span the dimension D which represents the front or forward margin of the double sink 16. The panel portion 24 has a length so as to, when position is shown in FIG. 1, depend downwardly from the counter top 14 to protect the faces 20.

Figure 2:
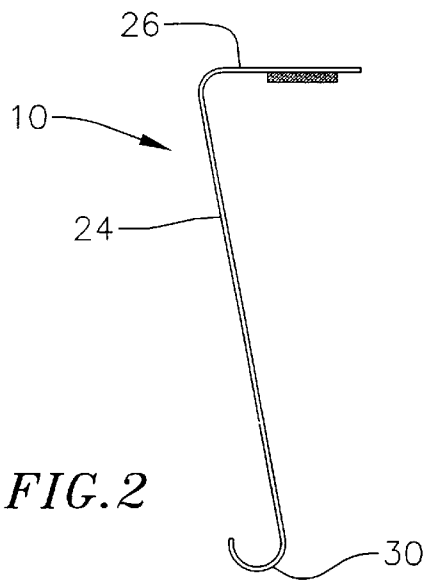
FIG. 2 is a side view of the guard of FIG. 1.

At its upper extremity, the panel portion 24 includes an upper margin 26 which, as shown in FIG. 2, extends at an angle which may be somewhat acute from the panel portion 24. In that typically the counter top 14 extends over the cabinets 12*a,b* to define a lip 28, by providing the angle between the upper margin 26 and panel portion 24, it is seen that the panel portion 24 is disposed out of the way of the user of the double sink 16, toward the faces 20 of the cabinets 12*a,b* for protection thereof.

At its bottom margin of the panel portion 24 there is included a trough 30 which is adapted to capture water and other fluids flowing downwardly along the panel portion 24 and to direct them away from the faces 20. The trough 30 extends the length of the guard 10 so as to direct accumulated fluids, should there be a sufficient amount, to the sides and away from impinging against the faces 20.

To removably secure the guard 10 to the counter top 14, hook and pile fasteners 32, or other suitable fasteners are provided. Accordingly when the guard 10 is not in use, it may be removed from the counter top 14 and stored. Alternatively, a friction fastener such as a rubber strip, with or without a tacky surface, may be used to removably secure the device 10 to the top 14.

The guard 10 is preferably fashioned from a clear, acrylic material, however, it is to be understood that it could be fashioned to any desirable color or color pattern.

While I have shown and described certain embodiments of the present invention, it is to be understood that it is subject many modifications and changes without departing from the spirit and scope of the present invention.

I claim:

1. A guard to prevent water from splashing on cabinetry including a sink, said cabinetry including a horizontal counter top mounting the sink, vertically disposed cabinet faces disposed below the counter top and a counter top lip projecting forwardly of the cabinet faces, the sink having a near boundary dimension, the guard comprising:

a panel having a longitudinal dimension substantially co-extensive with the near boundary dimension of the sink, a longitudinally extending, horizontal upper margin to overlay the lip and disposed at an acute angle relative to the panel and a trough at the lower margin to, when the panel is attached to the lip to direct the panel rearwardly to locate the trough adjacent the cabinet faces; and means for temporarily securing the panel to dispose the upper margin co-extensive and proximate the sink near boundary to position the panel over the cabinetry faces wherein the temporary securing means is a hook and pile fastener.

* * * * *